US007521879B2

(12) United States Patent
Hong et al.

(10) Patent No.: US 7,521,879 B2
(45) Date of Patent: Apr. 21, 2009

(54) DEVICE FOR DRIVING LIGHT EMITTING DIODE

(75) Inventors: Hee Jung Hong, Seoul (KR); Haang Rhym Chu, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 11/639,222

(22) Filed: Dec. 15, 2006

(65) Prior Publication Data

US 2007/0145914 A1 Jun. 28, 2007

(30) Foreign Application Priority Data

Dec. 22, 2005 (KR) ..... 10-2005-0128071

(51) Int. Cl.
*H05B 37/02* (2006.01)

(52) U.S. Cl. ..... 315/307; 315/216; 315/247; 315/312

(58) Field of Classification Search ..... 315/209 R, 315/224–226, 246, 247, 291, 307–308, 312, 315/216; 345/82, 102, 204; 362/227, 800
See application file for complete search history.

(56) References Cited

U.S. PATENT DOCUMENTS 6,621,235 B2 * 9/2003 Chang ..... 315/216
2002/0158590 A1 * 10/2002 Saito et al. ..... 315/291
2004/0160199 A1 * 8/2004 Morgan et al. ..... 315/312
2004/0251854 A1 * 12/2004 Matsuda et al. ..... 315/291
2005/0231459 A1 * 10/2005 Furukawa ..... 345/102
2006/0022616 A1 * 2/2006 Furukawa et al. ..... 315/309
2006/0038803 A1 * 2/2006 Miller et al. ..... 345/204
2006/0082529 A1 * 4/2006 Oyama ..... 345/82
2006/0261752 A1 * 11/2006 Lee ..... 315/291
2007/0001625 A1 * 1/2007 Kim ..... 315/312
2007/0046485 A1 * 3/2007 Grootes et al. ..... 340/815.45
2007/0085489 A1 * 4/2007 Robinson et al. ..... 315/224
2007/0108843 A1 * 5/2007 Preston et al. ..... 307/112
2007/0115248 A1 * 5/2007 Roberts et al. ..... 345/102
2007/0159750 A1 * 7/2007 Peker et al. ..... 361/93.1

* cited by examiner

*Primary Examiner*—David Hung Vu
*Assistant Examiner*—Tung X Le
(74) *Attorney, Agent, or Firm*—Holland & Knight LLP

(57) ABSTRACT

A device for driving a plurality of light emitting diodes includes a plurality of light emitting diode groups in series; a current providing unit for providing a current to the plurality of light emitting diode groups; and at least one current path controller in parallel with a corresponding one of the light emitting diode groups for turning off the corresponding one of the light emitting diode groups in accordance with a control signal.

14 Claims, 7 Drawing Sheets

DEVICE FOR DRIVING LIGHT EMITTING DIODE

This application claims the benefit of Korean Patent Application No. 10-2005-0128071, filed on Dec. 22, 2005, which is hereby incorporated by reference in its entirety.

BACKGROUND OF THE INVENTION

1. Field of the invention

Embodiments of the present invention relates to a light emitting diode, and more particularly to a light emitting diode for a liquid crystal display device. Embodiments of the invention are suitable for a wide scope of applications. In particular, embodiments of the invention are suitable for driving a light emitting diode for a liquid crystal display device.

2. Description of the Related Art

Today, electronic display devices are widely used in information driven society. A variety of electronic display devices are being used in various industries. Accordingly, new types of electronic display industry have been and are being developed to satisfy the continually changing needs and requirements of the information driven society.

In general, the electronic display device transmits visual information by converting an electronic signal into an optical signal. For example, the electronic display device may include a light emitting display device, which uses light emission to display the optical signal. In another example, the electronic display device may include a light receiving display device, which uses reflection, scattering, and interference for modulating and displaying the optical signal.

The light emitting display device is called an active display device, examples of which are a cathode ray tube (CRT), a plasma display panel (PDP), an organic electro luminescent display (OELD), and a light emitting diode (LED) display. The light receiving display device is called an inactive display device, examples of which are a liquid crystal display (LCD) and an electro phoretic image display EPID.

The CRT display device has been widely used as a display device for television or computer monitor for a long-time. However, the CRT is heavy, relatively bulky, and has a high power consumption. Recent improvement in semiconductor technology lead to the development of a flat panel display device, which is thin, light and consumes relatively less power. The flat panel display devices being developed include, for example, the LCD, the PDP, and the OELD. The LCD device is of particular interest for use in small electronic devices because it is slim, and thin, and has a low power consumption.

The LCD device includes an LCD panel including a first transparent insulating substrate having a common electrode, a color filter, and a black matrix; a second transparent insulating substrate having a switching element and a pixel electrode; and a liquid crystal material having an anisotropic dielectric constant injected between the first and second transparent insulating substrates. Different voltages are applied to the pixel electrode and the common electrode of the LCD device to adjust a magnitude of an electric field of the liquid crystal material and vary a molecular arrangement of the liquid crystal material. Thus, the amount of light transmitted through the first and second transparent substrates is controlled by the voltage difference between the pixel and common electrodes to display a desired image on the LCD panel.

Because the LCD device is a light receiving display device, it cannot emit the light by itself. Accordingly, a backlight is provided in the back of the LCD panel. The backlight projects light on the LCD panel and maintains a uniform total brightness for the LCD display. The backlight may include a cold cathode fluorescent lamp (CCFL) or an external electrode fluorescent lamp (EEFL) as a light source.

However, the LED is gaining interest as a next generation light source for the backlight because of potential energy saving and quasi-permanent use compared with the CCFL and the EEFL. The use of LED as a backlight source has been so far limited to small-sized LCDs, such as in portable phones. However, recent improvement in the luminance of LEDs expands the use of LEDs as backlight source for mid-size to large LCD devices.

FIG. 1 is a circuit diagram illustrating a device for driving an LED as a light source in a backlight of an LCD device according to the related art. Referring to FIG. 1, the light source for the backlight of the LCD device includes three LED groups $D_{11}$ to $D_{13}$, $D_{21}$ to $D_{23}$, and $D_{31}$ to $D_{33}$. Constant current providing circuits 10, 20, and 30 are provided to power the respective LED groups $D_{11}$ to $D_{13}$, $D_{21}$ to $D_{23}$, and $D_{31}$ to $D_{33}$, respectively. For example, the constant current providing circuit 10 powers the first LED group $D_{11}$ to $D_{13}$ The constant current providing circuit 20 powers the second LED group $D_{21}$ to $D_{23}$. The constant current providing circuit 30 powers the third LED group $D_{31}$ to $D_{33}$. A pulse width modulation signal providing circuit 40 drives the constant current providing circuits 10, 20 and 30. The three groups of LEDs $D_{11}$ to $D_{13}$, $D_{21}$ to $D_{23}$, and $D_{31}$ to $D_{33}$ divide the backlight into three backlight regions, the luminance of which is independently controlled by the respective current providing circuits 10, 20 and 30.

In the related backlight, the constant current providing circuits 10, 20, and 30 should be provided in proportion to the number of the divided backlight regions. Thus, the number of required electronic elements for driving the light emitting diode increases with the number of backlight regions. Hence, the cost of the related art backlight also increases in relation to a number of divided backlight regions. Moreover, the wiring structure of a printed circuit board (PCB) becomes increasingly more complex in relation with the number of backlight regions.

SUMMARY OF THE INVENTION

Accordingly, embodiments of the present invention are directed to a sputtering apparatus that substantially obviates one or more problems due to limitations and disadvantages of the related art.

An object of the present invention is to provide a device for driving a light emitting diode for a backlight of a flat panel display that requires no more than one constant-current providing circuit.

Additional features and advantages of the invention will be set forth in the description of exemplary embodiments which follows, and in part will be apparent from the description of the exemplary embodiments, or may be learned by practice of the exemplary embodiments of the invention. These and other advantages of the invention will be realized and attained by the structure particularly pointed out in the written description of the exemplary embodiments and claims hereof as well as the appended drawings.

To achieve these and other advantages and in accordance with the purpose of the present invention, as embodied and broadly described, a device for driving a plurality of light emitting diodes includes a plurality of light emitting diode groups in series; a current providing unit for providing a current to the plurality of light emitting diode groups; and at least one current path controller in parallel with a corresponding one of the light emitting diode groups for turning off the corresponding one of the light emitting diode groups in accordance with a control signal.

In another aspect, a device for driving a plurality of light emitting diode in an LCD device includes a plurality of light emitting diodes groups in parallel; a current providing unit for providing a current to the plurality of light emitting diode groups; at least one switch in series with a corresponding one of the light emitting diode groups for activating the corresponding one of the light emitting diode groups in accordance with a control signal.

In another aspect, a device for driving a plurality of light emitting diode in an LCD device includes a plurality light emitting diodes groups in parallel; a current providing unit for providing a current to the light emitting diode groups; a plurality of switches, each of which in series with a corresponding one of the light emitting diode groups for activating the corresponding one of the light emitting diode groups in accordance with a corresponding control signal.

It is to be understood that both the foregoing general description and the following detailed description are exemplary and explanatory and are intended to provide further explanation of the invention as claimed.

BRIEF DESCRIPTION OF THE DRAWINGS

These and other objects of the invention will be apparent from the after detailed description of the embodiments of the present invention with reference to the accompanying drawings, in which.

DETAILED DESCRIPTION OF EXEMPLARY EMBODIMENTS

Preferred embodiments of the present invention will be described in a more detailed manner with reference to the drawings.

Figure 1:
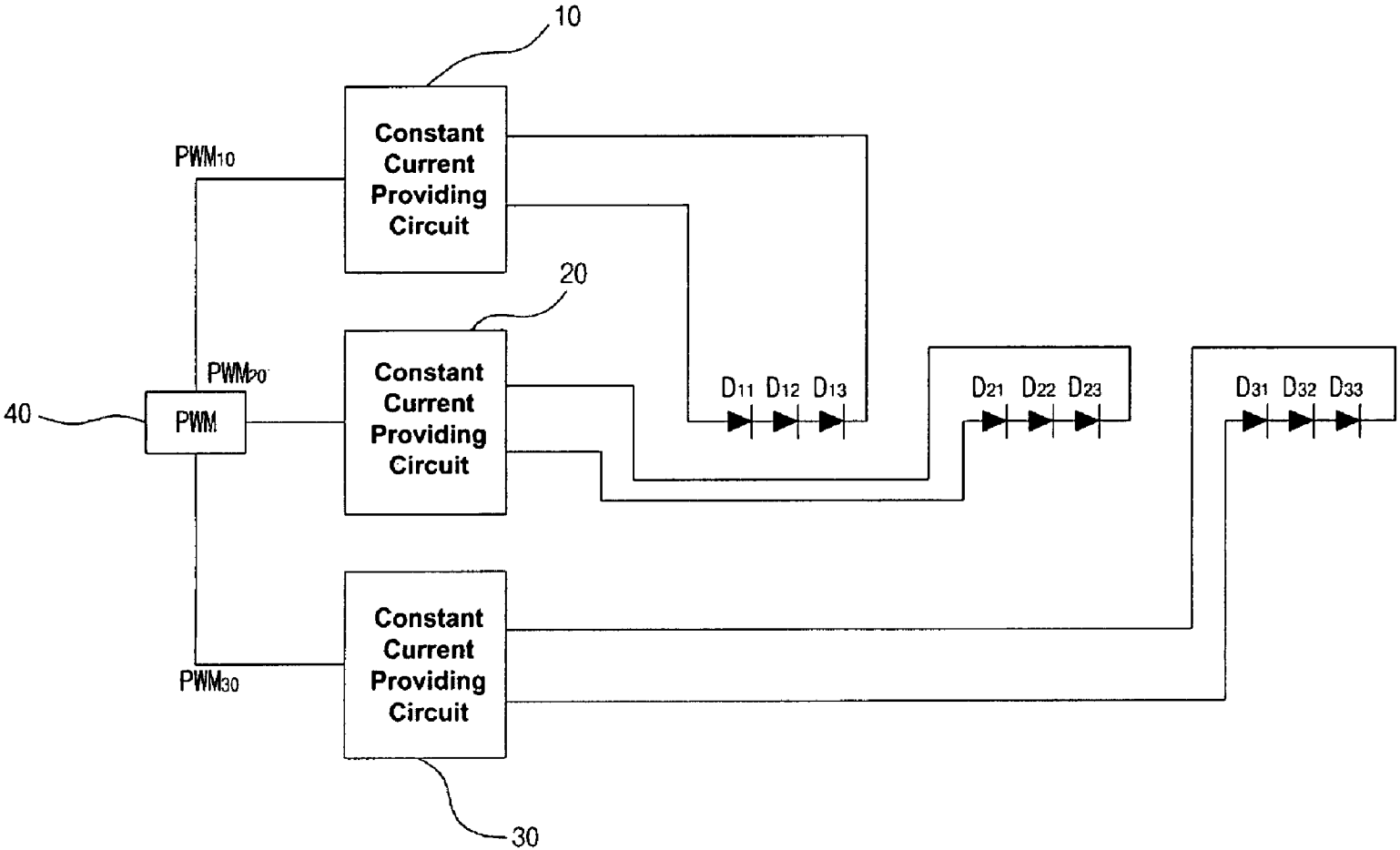
FIG. 1 RELATED ART
FIG. 1 is a circuit diagram illustrating a device for driving an LED as a light source in a backlight of an LCD device according to the related art.
Figure 2:
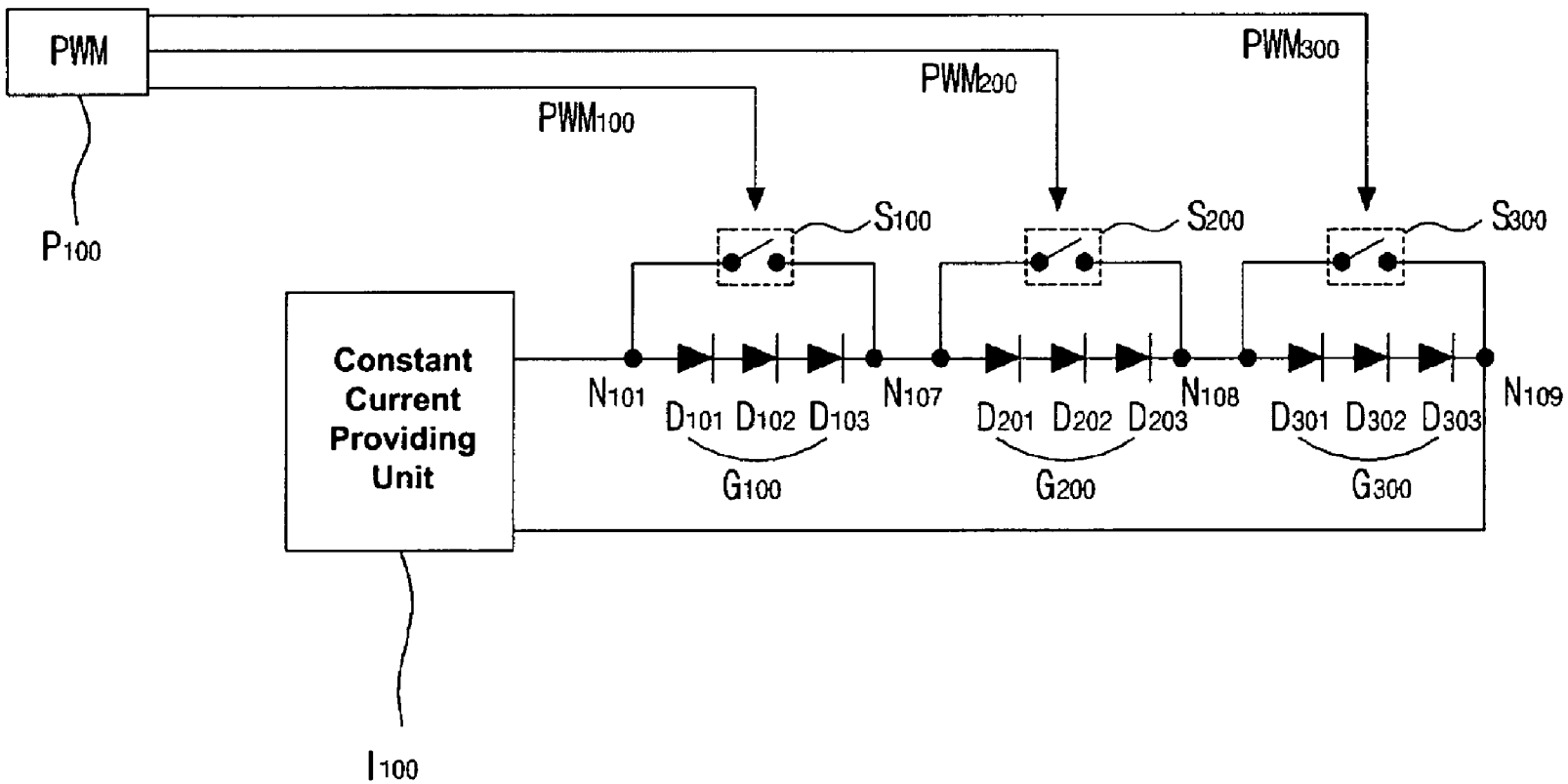
FIG. 2 is a schematic diagram of an exemplary device for driving a plurality of LEDs as a light source in a backlight of an LCD device according to an embodiment of the present invention.

FIG. 2 is a schematic diagram of an exemplary device for driving a plurality of LEDs as a light source in a backlight of an LCD device according to an embodiment of the present invention. Referring to FIG. 2, the exemplary device for driving the LED includes a plurality of LEDs $D_{101}$ to $D_{103}$, $D_{201}$ to $D_{203}$, and $D_{301}$ to $D_{303}$ connected in series, a constant-current providing unit $I_{100}$, current path controllers $S_{100}$, $S_{200}$, and $S_{300}$, and a current path control signal providing unit $P_{100}$.

The LEDs $D_{101}$ to $D_{103}$, $D_{201}$ to $D_{203}$, and $D_{301}$ to $D_{303}$ are divided into LED groups $G_{100}$, $G_{200}$, and $G_{300}$. For example, the LED group $G_{100}$ includes light emitting $D_{101}$ to $D_{103}$ connected in series. The LED group $G_{200}$ includes LEDs $D_{201}$ to $D_{203}$ connected in series. And, the LED group $G_{300}$ includes LEDs $D_{301}$ to $D_{303}$ connected in series. Thus, the LED groups $G_{100}$, $G_{200}$, and $G_{300}$ are connected in series with each other. The constant-current providing unit $I_{100}$ provides a substantially constant current I to the LED groups $G_{100}$, $G_{200}$, and $G_{300}$.

The current path controllers $S_{100}$, $S_{200}$, and $S_{300}$ are connected in parallel with the LED groups $G_{100}$, $G_{200}$, and $G_{300}$, respectively. The current path controllers $S_{100}$, $S_{200}$, and $S_{300}$ control a current path of the constant current I provided by the constant-current providing unit $I_{100}$ in accordance with current path control signals, such as pulse signals $PWM_{100}$, $PWM_{200}$, and $PWM_{300}$, respectively, provided by the current path control signal providing unit $P_{100}$.

Figure 3:
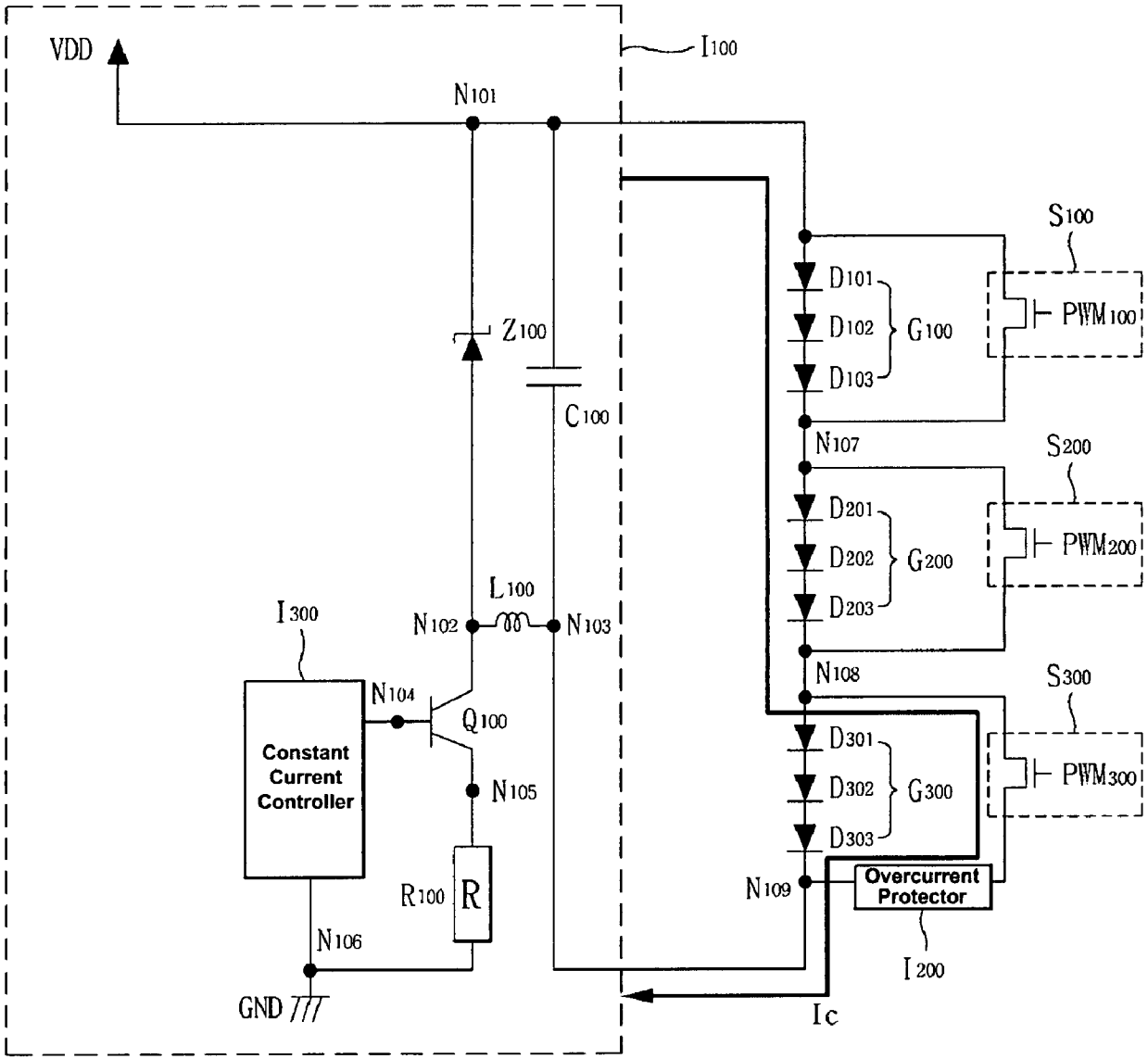
FIG. 3 is a circuit diagram of an exemplary device for driving a plurality of LEDs as a light source in a backlight of an LCD device according to an embodiment of the present invention.

FIG. 3 is a circuit diagram of an exemplary device for driving a plurality of LEDs as a light source in a backlight of an LCD device according to an embodiment of the present invention. Referring to FIG. 3, the constant-current providing unit $I_{100}$ includes a constant current controller $I_{300}$, a voltage drop circuit, and a resistor $R_{100}$. The voltage drop circuit drops a power source voltage VDD to a predetermined voltage. The voltage drop circuit may be, for example, a buck type voltage drop circuit.

The buck type voltage drop circuit may include a switching element $Q_{100}$, an inductor $L_{100}$, and a capacitor $C_{100}$. The switching element $Q_{100}$ may include a metal oxide semiconductor field effect transistor (MOSFET) or a bipolar junction transistor (BJT). A Zener diode $Z_{100}$ is connected between a first node $N_{101}$, and a second node $N_{102}$. The inductor $L_{100}$ is connected between the second node $N_{102}$ and a third node $N_{103}$. The capacitor $C_{100}$ is connected between the first node $N_{101}$ and the third node $N_{103}$.

The constant current controller $I_{300}$ is connected between a fourth node $N_{104}$ and a sixth node $N_{106}$. The switching element $Q_{100}$ is connected between the second node $N_{102}$, the fourth node $N_{104}$, and a fifth node $N_{105}$. The resistor $R_{100}$ is connected between the fifth node $N_{105}$ and the sixth node $N_{106}$. The power source voltage VDD is applied to the first node $N_{101}$. The sixth node $N_{106}$ is connected to the ground GND.

The first LED group $G_{100}$ is connected between the first node $N_{101}$ and a seventh node $N_{107}$. The first current path controller $S_{100}$ is also connected between the first node $N_{101}$ and the seventh node $N_{107}$ in parallel with the first LED group $G_{100}$. The second LED group $G_{200}$ is connected between the seventh node $N_{107}$ and an eighth node $N_{108}$. The second current path controller $S_{200}$ is also connected between the seventh node $N_{107}$ and the eighth node $N_{108}$ in parallel with the second LED group $G_{200}$. The third LED group $G_{300}$ is connected between the eighth node $N_{108}$ and the third node $N_{103}$. The third current path controller $S_{300}$ is also connected between the eighth node $N_{108}$ and the third node $N_{103}$. in parallel with the third current path controller $S_{300}$.

The switching element $Q_{100}$ is activated or deactivated by a pulse signal provided by the constant current controller $I_{300}$. When the switching element $Q_{100}$ is activated, an electric energy is stored in the inductor $L_{100}$ or the capacitor $C_{100}$. When the switching element $Q_{100}$ is deactivated, the energy stored in the inductor $L_{100}$ and the capacitor $C_{100}$ is emitted to one or more of the LED groups $G_{100}$, $G_{200}$, and $G_{300}$.

The Zener diode $Z_{100}$ suppresses a supply of over-voltage to the switching element $Q_{100}$. The resistor $R_{100}$ controls a magnitude of an electric current flowing through the switching element $Q_{100}$. The constant current controller $I_{300}$ controls a duty ratio of the pulse signal or a frequency of the pulse signal provided to the switching element $Q_{100}$. Thus, the buck type voltage drop circuit drops the power source voltage VDD to a predetermined voltage. For example, the buck type voltage drop circuit may drop the provided power source voltage VDD from about 24 volts to about 6 volts to 18 volts to power one or more of the LED groups $G_{100}$, $G_{200}$, and $G_{300}$.

The first current path controller $S_{100}$ controls the current path of the constant current I provided to the first LED group $G_{100}$. The second current path controller $S_{200}$ controls the current path of the constant current I provided to the second LED group $G_{200}$. The third current path controller $S_{300}$ controls the current path of the constant current I that is provided by the constant-current providing unit $I_{100}$ to the second LED group $G_{200}$. The current path controllers $S_{100}$, $S_{200}$, and $S_{300}$ may include metal oxide semiconductor field effect transistors (MOSFET) or bipolar junction transistors (BJT). For example, as shown in FIG. 3, the current path controllers $S_{100}$, $S_{200}$, and $S_{300}$ may include n-type metal oxide semiconductor field effect transistors (nMOSFET).

Figure 4:
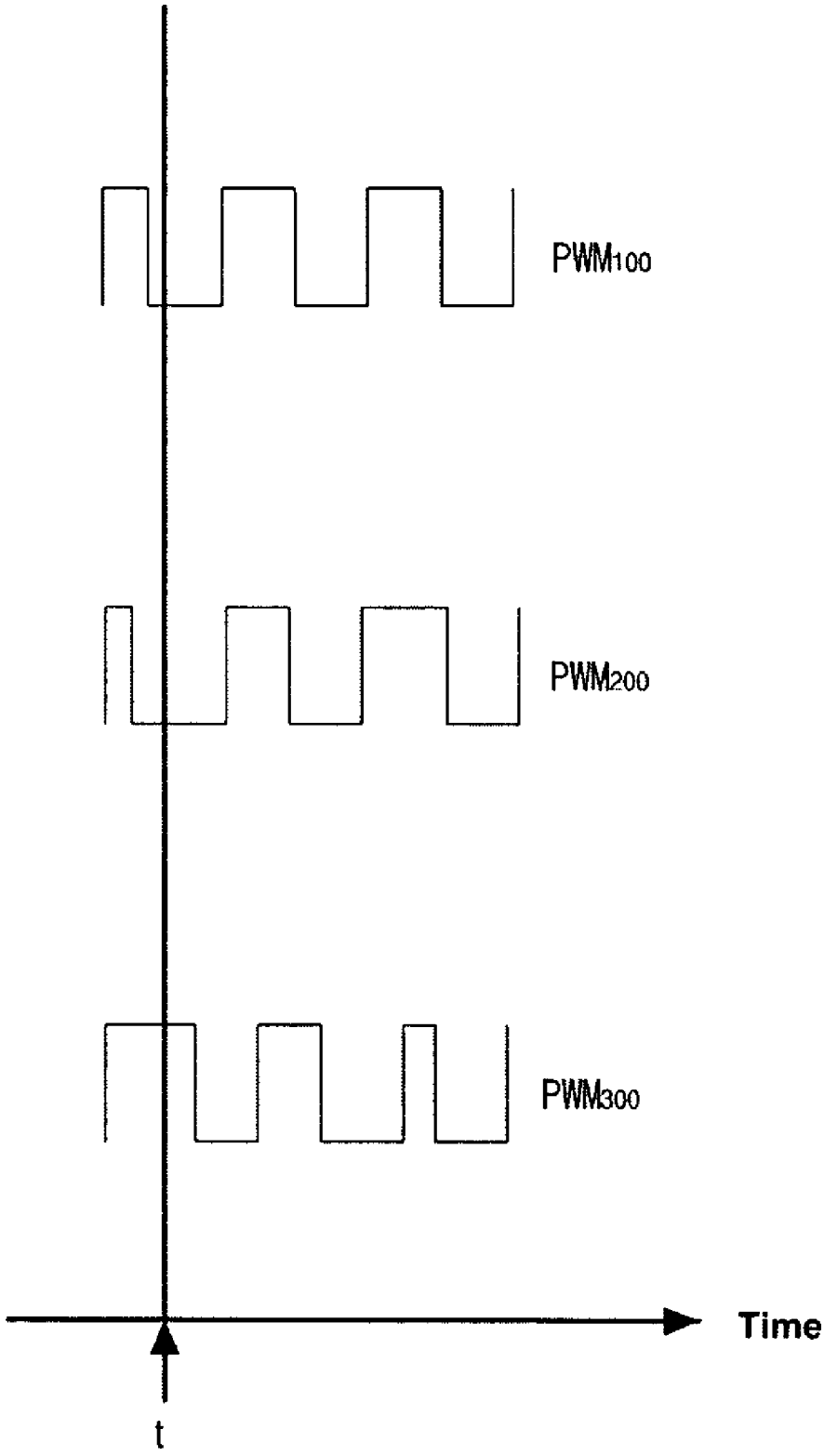
FIG. 4 is a graphical illustration of exemplary current path control signals for controlling the driving of LEDs of FIGS. 2 and 3 according to an embodiment of the present invention.

FIG. 4 is a graphical illustration of exemplary current path control signals for controlling the driving of LEDs of FIGS. 2 and 3 according to an embodiment of the present invention. Referring to FIGS. 3 and 4, the first current path control signal $PWM_{100}$ is applied to the first current path controller $S_{100}$, the second current path control signal $PWM_{200}$ to the second current path controller $S_{200}$, and the third current path control signal $PWM_{300}$ to the third current path controller $S_{300}$. For example, the first current path controller $S_{100}$ and the second current path controller $S_{200}$ are turned off and the third current path controller $S_{300}$ is turned on at a time t. Accordingly, as shown in FIG. 3, a current path Ic is formed from the constant-current providing unit $I_{100}$ through the first LED group $G_{100}$, the second LED group $G_{200}$, and the third current path controller $S_{300}$, bypassing the third LED group $G_{300}$. Hence, the constant current I is provided to the first LED group $G_{100}$ and the second LED group $G_{200}$, thereby turning on the LEDs $D_{101}$ to $D_{103}$ of the first LED group $G_{100}$, and the LEDs $D_{201}$ to $D_{203}$ of the second LED group $G_{200}$. However, the LEDs $D_{301}$ to $D_{303}$ of the third LED group $G_{300}$ are turned off because the third LED group $G_{300}$ is bypassed by the third current path controller $S_{300}$.

Thus, according to an embodiment of the present invention, one constant-current providing unit $I_{100}$ is enough to power the plurality of LED groups $G_{100}$, $G_{200}$, and $G_{300}$. The current path through individual ones of the of the LED groups $G_{100}$, $G_{200}$, and $G_{300}$ is controlled with the current path controller $S_{100}$, $S_{200}$, and $S_{300}$ which may bypass one or more of the LED groups $G_{100}$, $G_{200}$, and $G_{300}$.

In an embodiment of the present invention, the number n of the LEDs $D_{101}$ to $D_{103}$, $D_{201}$ to $D_{203}$, and $D_{301}$ to $D_{303}$ in the respective LED groups $G_{100}$, $G_{200}$, and $G_{300}$ may be within a range of about 2 to about 15. The number n may be chosen in accordance with a desired voltage to be applied to the respective current path controllers $S_{100}$, $S_{200}$, and $S_{300}$. The voltage applied to a particular one of the current path controllers $S_{100}$, $S_{200}$, and $S_{300}$ increases with the number of LEDs in the particular one of the path controllers $S_{100}$, $S_{200}$, and $S_{300}$.

Referring back to FIG. 3, the third current path controller $S_{300}$ can further include an over-current protector $I_{200}$. The over-current protector $I_{200}$ can limit the current flowing through the current path controllers $S_{100}$, $S_{200}$, and $S_{300}$ to avoid a flow of over-current The over-current protector $I_{200}$ may include a Zener diode or a resistor.

Figure 5:
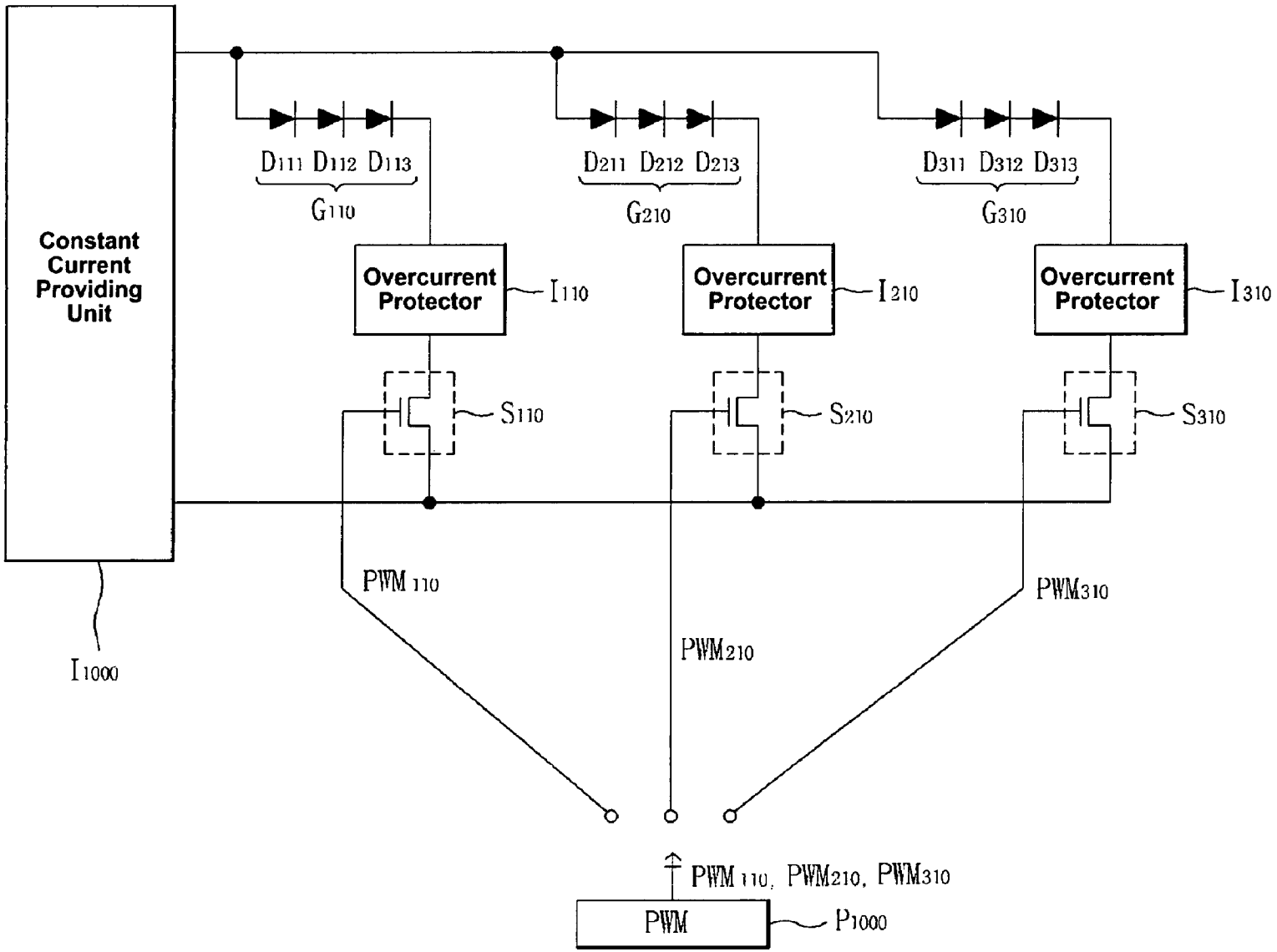
FIG. 5 is a schematic diagram of an exemplary device for driving a plurality of LEDs as a light source in a backlight of an LCD device according to another embodiment of the present invention.

FIG. 5 is a schematic diagram of an exemplary device for driving a plurality of LEDs as a light source in a backlight of an LCD device according to another embodiment of the present invention. Referring to FIG. 5, the device for driving the LED includes LED groups $G_{110}$, $G_{210}$, and $G_{310}$, a constant-current providing unit $I_{1000}$, group activating units $S_{110}$, $S_{210}$, and $S_{310}$, and a group activation signal providing unit $P_{1000}$. The LED groups $G_{110}$, $G_{210}$, and $G_{310}$ have a plurality k of LEDs $D_{111}$ to $D_{113}$, $D_{211}$ to $D_{213}$, and $D_{311}$ to $D_{313}$ connected in series. The LED groups $G_{110}$, $G_{210}$, and $G_{310}$ are connected in parallel with each other.

The constant-current providing unit $I_{1000}$ provides a constant current to the LED groups $G_{110}$, $G_{210}$, and $G_{310}$. The group activating units $S_{110}$, $S_{210}$, and $S_{310}$ are connected in series with the LED groups $G_{110}$, $G_{210}$, and $G_{310}$, respectively, and activate the LED groups $G_{110}$, $G_{210}$, and $G_{310}$, respectively.

The group activation signal providing unit $P_{1000}$ provides group activation signals, such as pulse signals $PWM_{110}$, $PWM_{210}$, and $PWM_{310}$, to the group activating units $S_{110}$, $S_{210}$, and $S_{310}$, respectively. The group activation signal providing unit $P_{1000}$ can sequentially provide the group activation signals $PWM_{110}$, $PWM_{210}$, and $PWM_{310}$ for a predetermined time. For example, when the device for driving the LED is driven at a frequency of about 60 Hz, the group activation signal providing unit $P_{1000}$ can sequentially provide the group activation signals $PWM_{110}$, $PWM_{210}$, and $PWM_{310}$ each for about 1/60 seconds 16.7 msec.

Figure 6:
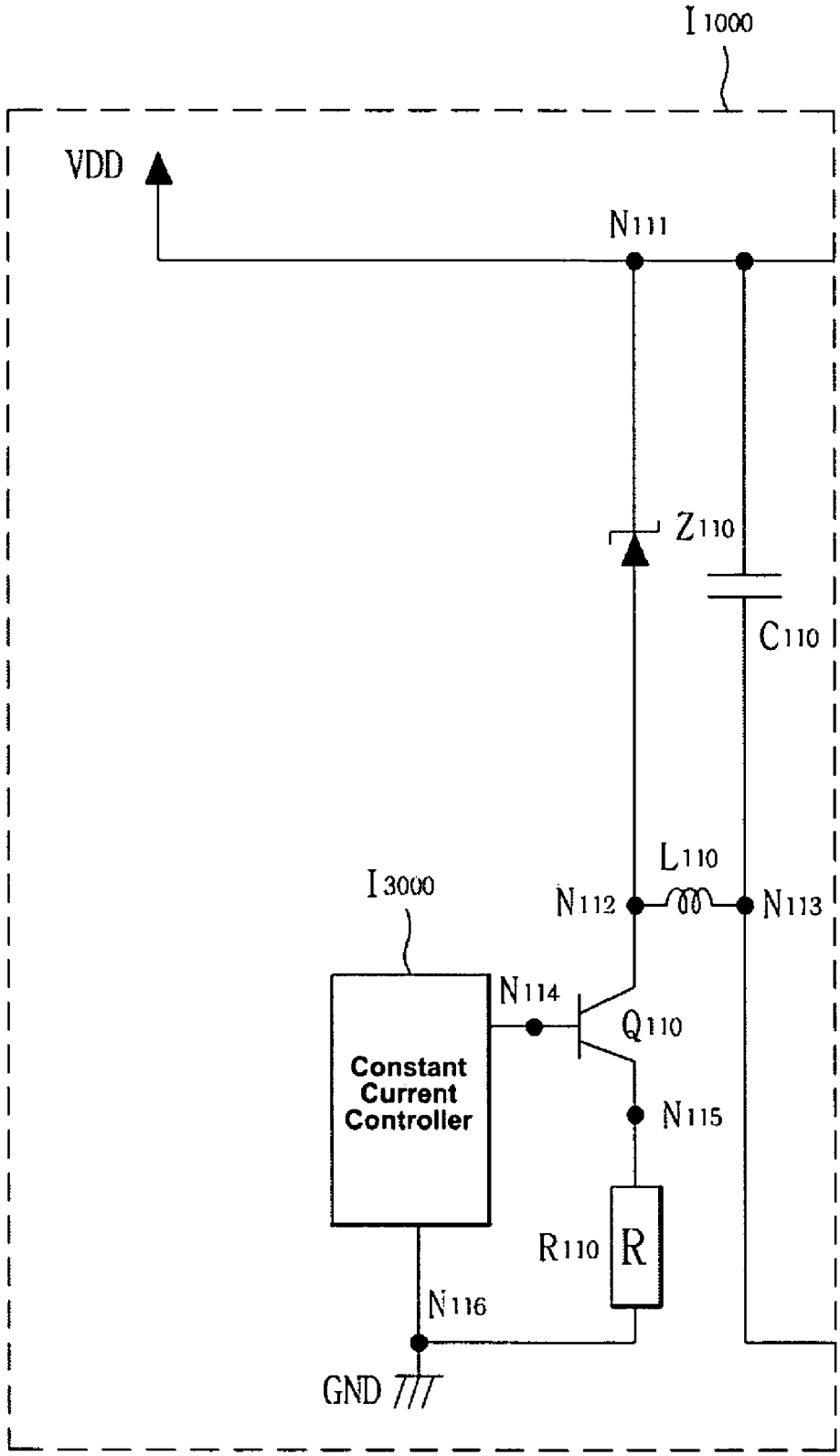
FIG. 6 is a circuit diagram of an exemplary constant-current providing unit for the device for driving a plurality of LEDs of FIG. 5.
Figure 7:
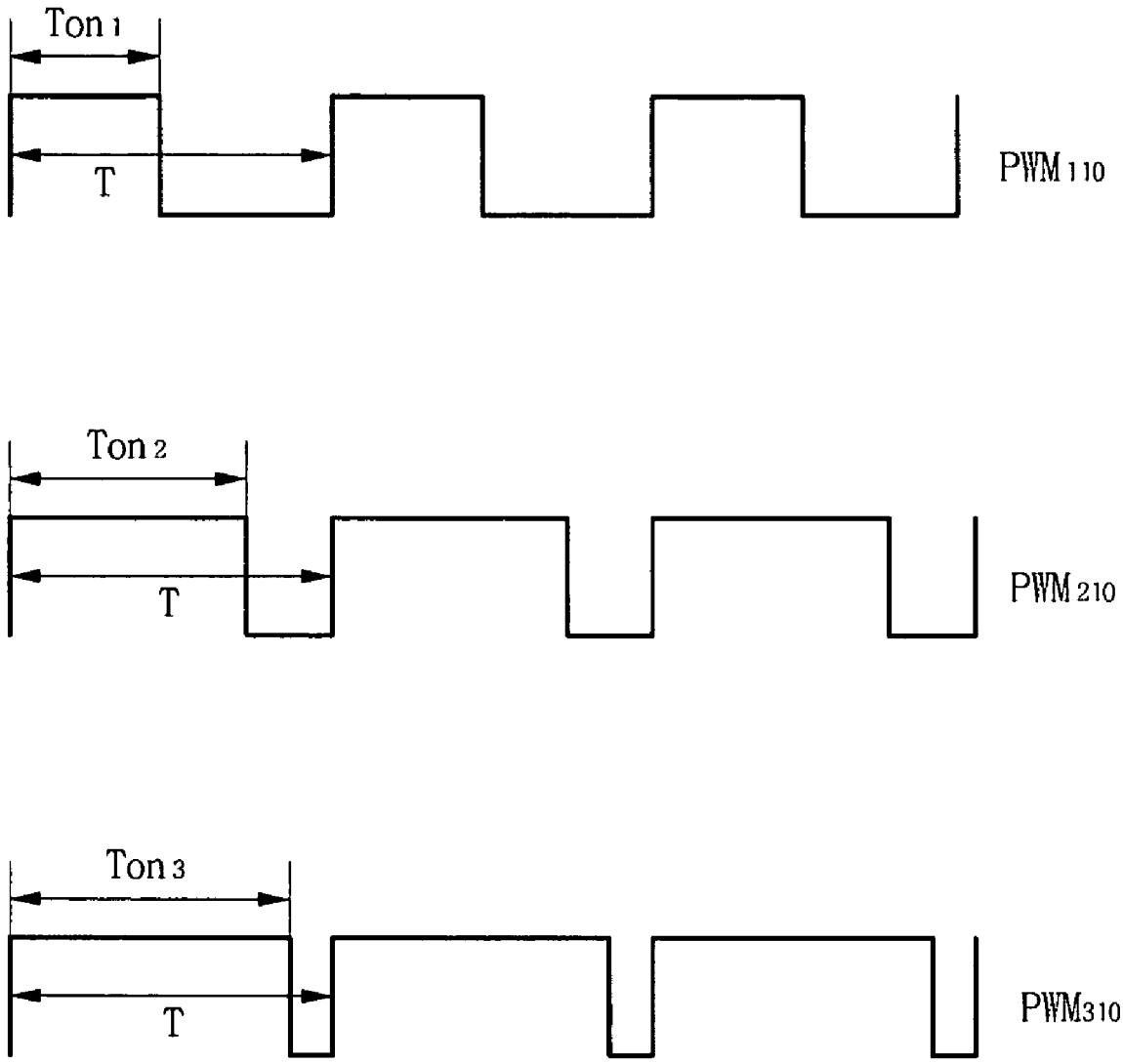
FIG. 7 is a graphical illustration of exemplary group activation signals in a device for driving a light emitting diode according to anther embodiment of the present invention.

FIG. 6 is a circuit diagram of an exemplary constant-current providing unit for the device for driving a plurality of LEDs of FIG. 5. FIG. 7 is a graphical illustration of exemplary group activation signals in a device for driving a light emitting diode according to anther embodiment of the present invention. Referring to FIG. 6, the constant-current providing unit $I_{1000}$ includes a constant current controller $I_{3000}$, a voltage drop circuit, and a resistor $R_{110}$. The voltage drop circuit drops a power source voltage VDD to a predetermined voltage. As described above, a buck type voltage drop circuit may be used. For example, the buck type voltage drop circuit may include a switching element $Q_{100}$, an inductor $L_{100}$, and a capacitor $C_{100}$. The switching element $Q_{100}$ may include a metal oxide semiconductor field effect transistor MOSFET or a bipolar junction transistor BJT.

A Zener diode $Z_{100}$ is connected between a first node $N_{111}$ and a second node $N_{112}$. An inductor $L_{110}$ is connected between the second node $N_{112}$ and a third node $N_{113}$. A capacitor $C_{110}$ is connected between the first node $N_{111}$ and the third node $N_{113}$. The constant current controller $I_{3000}$ is connected between a fourth node $N_{114}$ and a sixth node $N_{116}$. The switching element $Q_{110}$ is connected between the second node $N_{112}$, the fourth node $N_{114}$, and a fifth node $N_{115}$. The resistor $R_{110}$ is connected between the fifth node $N_{115}$ and the sixth node $N_{116}$.

The first LED group $G_{110}$ and the first group activating unit $S_{110}$ are connected between the first node $N_{111}$ and the third node $N_{113}$. The second LED group $G_{210}$ and the second group activating unit $S_{210}$ are connected in parallel with the first LED group $G_{110}$ and the first group activating unit $S_{110}$. The third LED group $G_{310}$ and the third group activating unit $S_{310}$ are connected in parallel with the first LED group $G_{110}$ and the first group activating unit $S_{110}$. The power source voltage VDD is applied to the first node $N_{111}$. The sixth node $N_{116}$ is connected the ground GND.

The switching element $Q_{110}$ is activated or deactivated by a pulse signal provided by the constant current controller $I_{3000}$. When the switching element $Q_{110}$ is activated, an electric energy is stored in the inductor $L_{110}$ or the capacitor $C_{110}$. When the switching element $Q_{110}$ is deactivated, the energy stored in the inductor $L_{110}$ and the capacitor $C_{110}$ is emitted to the LED groups $G_{110}$, $G_{210}$, and $G_{310}$.

The Zener diode $Z_{110}$ prevents a supply of an excessive voltage to the switching element $Q_{110}$. The resistor $R_{110}$ controls a magnitude of an electric current flowing through the switching element $Q_{110}$. The constant current controller $I_{3000}$ controls a duty ratio of the pulse signal or a frequency of the pulse signal provided to the switching element $Q_{110}$. Thus, the buck type voltage drop circuit drops the power source voltage VDD to a predetermined voltage. For example, when the device for driving the LED is used for a backlight for a liquid crystal display, the power source voltage VDD of about 24 volts is provided and dropped to a voltage of about 6 volts to 18 volts using the buck type voltage drop circuit, and is provided to the LED groups $G_{110}$, $G_{210}$, and $G_{310}$.

The first group activating unit $S_{110}$ may be activated by the first group activation signal $PWM_{110}$ and provides the constant current received from the constant-current providing unit $I_{1000}$ to the first LED group $G_{110}$, thereby activating the first LED group $G_{110}$. Next, the second group activating unit $S_{210}$ may be activated by a second group activation signal $PWM_{210}$ and provides the constant current received from the constant-current providing unit $I_{1000}$ to the second LED group $G_{210}$, thereby activating the second LED group G210. Next, the third group activating unit $S_{310}$ may be activated by the third group activation signal $PWM_{310}$ and provides the constant current received from the constant-current providing unit $I_{1000}$ to the third LED group $G_{310}$, thereby activating the third LED group $G_{310}$.

The group activating units $S_{110}$, $S_{210}$, and $S_{310}$ may be switches, for example metal oxide semiconductor field effect transistors (MOSFET) or bipolar junction transistors (BJT). For example, as shown in FIG. 5, the group activating units $S_{110}$, $S_{210}$, and $S_{310}$ may include n-type metal oxide semiconductor field effect transistors (nMOSFET).

The first group activation signal $PWM_{110}$ is applied to the first group activating unit $S_{110}$, the second group activation signal $PWM_{210}$ to the second group activating unit $S_{210}$, and the third group activation signal $PWM_{310}$ to the third group activating unit $S_{310}$ as shown in FIG. 7. For example, the group activating units are activated and the LED groups are activated during time periods $Ton_1$, $Ton_2$, and $Ton_3$ for sustaining the group activation signals $PWM_{110}$, $PWM_{210}$, and $PWM_{310}$ in high states.

Simply, each of activation times of the LED groups $G_{110}$, $G_{210}$, and $G_{310}$ can be controlled in proportion to each of the duty ratios $Ton_1/T$, $Ton_2/T$, and $Ton_3/T$ of the group activation signals $PWM_{110}$, $PWM_{210}$, and $PWM_{310}$. As shown in FIG. 7, when the duty ratio $Ton_1/T$ of the first group activation signal $PWM_{110}$ is the shortest, and the duty ratio $Ton_3/T$ of the third group activation signal $PWM_{310}$ is the longest, the activation time of the first LED group $G_{110}$ is the shortest, and the activation time of the third LED group $G_{310}$ is the longest. Accordingly, each of the LED groups $G_{110}$, $G_{210}$, and $G_{310}$ can be independently controlled in luminance. Therefore, in the case of the use for the backlight for the liquid crystal display, the luminance can be locally controlled.

According to an embodiment of the present invention, the device for driving the LED can control the activation times of the respective LED groups $G_{110}$, $G_{210}$, and $G_{310}$, using the group activating units $S_{110}$, $S_{210}$, and $S_{310}$ for the respective LED groups $G_{110}$, $G_{210}$, and $G_{310}$. Thus, the luminance of the respective LED groups $G_{110}$, $G_{210}$, and $G_{310}$ can be independently controlled even while using only one constant-current providing unit $I_{1000}$.

The number n of the LEDs $D_{111}$ to $D_{113}$, $D_{211}$ to $D_{213}$, and $D_{311}$ to $D_{313}$ in respective LED groups $G_{110}$, $G_{210}$, and $G_{310}$ maybe within a range of about 2 to about 15. The number n may be chosen in accordance with a desired voltage to be applied to the respective group activating units $S_{110}$, $S_{210}$, and $S_{310}$. The voltage applied to a particular one of the group activating units $S_{110}$, $S_{210}$, and $S_{310}$ increases with the number of LEDs in the particular one of the group activating units $S_{110}$, $S_{210}$, and $S_{310}$.

Referring back to FIG. 5, over-current protectors $I_{110}$, $I_{210}$, and $I_{310}$ may be further provided between the LED groups $G_{110}$, $G_{210}$, and $G_{310}$ and the group activating units $S_{110}$, $S_{210}$, and $S_{310}$, respectively. Thus, the over-current protectors $I_{110}$, $I_{210}$, and $I_{310}$ can prevent a flow of over-current through the group activating units $S_{110}$, $S_{210}$, and $S_{310}$. The over-current protectors $I_{110}$, $I_{210}$, and $I_{310}$ may include Zener diodes or resistors.

As described above, in the device for driving the LED according to the present invention, in the case of the use for a backlight of a flat panel display, e.g., the liquid crystal display, the plurality of the LEDs can be divided into a plurality of groups and driven using one constant-current providing circuit, thereby simplifying its circuit construction, and reducing its cost.

Thus, according to an embodiment of the present invention, one constant-current providing unit is enough to power the plurality of LED groups. The device for driving the LED can control the activation times of the respective LED groups using group activating units corresponding to the respective LED groups. Thus, the luminance of the respective LED groups can be independently controlled even while using only one constant-current providing unit.

It will be apparent to those skilled in the art that various modifications and variations can be made in the exemplary embodiments the processing apparatus of the present invention. Thus, it is intended that embodiments of the present invention cover the modifications and variations of the embodiments described herein provided they come within the scope of the appended claims and their equivalents.

What is claimed is:

1. A backlight unit including a plurality of light emitting diodes, comprising:

a plurality of light emitting diode groups in series;

a current providing unit for providing a current to the plurality of light emitting diode groups;

a current path control signal providing unit generating control signals, which are different from each other;

current path controllers, wherein each of the current path controllers is in parallel connected to each of the light emitting diode groups for turning on and off the light emitting diode groups in accordance with the control signals; and a over-current protector suppressing a over-current input through last one of the current path controllers coupled with the current providing unit, wherein the current path control signal providing unit generates a first control signal for controlling a first light emitting diode group, a second control signal for controlling a second light emitting diode group, and a third control signal for controlling a third light emitting diode group, and wherein a phase of the first control signal is different from phases of the second and third control signals when the first light emitting diode group is turned on and the second and third light emitting diode groups are turned off, and the phase of the second control signal is the same as the phase of the third control signal.

2. The backlight unit of claim 1, wherein the current path controller includes a metal oxide semiconductor field effect transistor or a bipolar junction transistor.

3. The backlight unit of claim 1, wherein the over-current protector includes one of a Zener diode and a resistor.

4. The backlight unit of claim 1, wherein the number of the light emitting diodes in at least one of the emitting diode groups is in a range of about 2 to about 15.

5. The backlight unit of claim 1, wherein the control signal includes a pulse signal.

6. The backlight unit of claim 1, wherein the current from the current providing unit is substantially constant.

7. The backlight unit of claim 1, wherein the current providing unit comprises a voltage drop circuit which drops a power source voltage.

8. The backlight unit of claim 1, wherein the current providing unit further comprises:

a zener diode connected between a first node to which the power source voltage is applied, and a second node;

an inductor connected between the second node and a third node;

a capacitor connected between the first node and the third node;

a constant current controller connected between the fourth node and a sixth node to which a ground voltage is applied; and a switching element having a first terminal connected to the second node, a control terminal connected to the fourth node, and a second terminal connected to a fifth node, wherein the constant current controller controls at least one of a duty ratio and a frequency of a pulse signal, thereby controlling a switching element, and the voltage drop circuit is connected between the fifth node and the sixth node.

9. A device for driving a plurality of light emitting diodes in an LCD device, comprising:

a plurality of light emitting diode groups in parallel;

a current providing unit for providing a current to the plurality of light emitting diode groups;

a current path control signal providing unit generating control signals which are different from each other;

switches, wherein each of the switches are in series to each of the light emitting diode groups for activating the light emitting diode groups in accordance with the control signals; and an over-current protector in series with the at least one switch and the corresponding one of the light emitting diode groups for preventing a flow of over-current through the corresponding one of the switch, wherein the current path control signal providing unit generates a first control signal for controlling a first light emitting diode group, a second control signal for controlling a second light emitting diode group, and a third control signal for controlling a third light emitting diode group, and wherein a phase of the first control signal is different from phases of the second and third control signals when the first light emitting diode group is turned on and the second and third light emitting diode groups are turned off, and the phase of the second control signal is the same as the phase of the third control signal.

10. The device of claim 9, wherein the number of the light emitting diodes in at least one of the emitting diode groups is in a range of about 2 to about 15.

11. The device of claim 9, wherein the at least one switch includes a metal oxide semiconductor field effect transistor or a bipolar junction transistor.

12. The device of claim 9, wherein an activation time of the corresponding one of the light emitting diode groups is proportional to a duty ratio of the control signal.

13. The device of claim 9, wherein the current providing unit comprises a voltage drop circuit which drops an input power source voltage.

14. The device of claim 9, wherein the current providing unit further comprises:

a zener diode connected between a first node to which the power source voltage is applied, and a second node;

an inductor connected between the second node and a third node;

a capacitor connected between the first node and the third node;

a constant current controller connected between the fourth node and a sixth node to which a ground voltage is applied; and a switching element having a first terminal connected to the second node, a control terminal connected to the fourth node, and a second terminal connected to a fifth node, wherein the constant current controller controls at least one of a duty ratio and a frequency of a pulse signal, thereby controlling a switching element, and the voltage drop circuit is connected between the fifth node and the sixth node.

* * * * *